US009702084B2

(12) United States Patent
Saikkonen et al.

(10) Patent No.: US 9,702,084 B2
(45) Date of Patent: Jul. 11, 2017

(54) PROCESS AND A MACHINE FOR MAKING A TISSUE PAPER WEB

(71) Applicant: VALMET S.P.A., Milan (IT)

(72) Inventors: Olli Jaakko Antero Saikkonen, Gorizia (IT); Lorenzo Simeoni, Gorizia (IT); Ingvar Klerelid, Karlstad (SE)

(73) Assignee: VALMET S.P.A., Milan (IT)

( * ) Notice: Subject to any disclaimer, the term of this patent is extended or adjusted under 35 U.S.C. 154(b) by 0 days.

(21) Appl. No.: 15/107,365

(22) PCT Filed: Jan. 15, 2015

(86) PCT No.: PCT/EP2015/050620

§ 371 (c)(1),
(2) Date: Jun. 22, 2016

(87) PCT Pub. No.: WO2015/107094

PCT Pub. Date: Jul. 23, 2015

(65) Prior Publication Data

US 2017/0002515 A1 Jan. 5, 2017

(30) Foreign Application Priority Data

Jan. 15, 2015 (EP) ..... 14151720

(51) Int. Cl.
*D21F 5/18* (2006.01)
*D21F 5/20* (2006.01)
*D21F 11/14* (2006.01)

(52) U.S. Cl.
CPC ..... *D21F 5/181* (2013.01); *D21F 5/20* (2013.01); *D21F 11/14* (2013.01)

(58) Field of Classification Search
CPC . D21F 11/14; D21F 5/181; D21F 5/20; D21F 3/045; D21F 5/00; D21F 5/004; D21F 5/02; D21F 5/18
See application file for complete search history.

(56) References Cited

U.S. PATENT DOCUMENTS 3,432,936 A * 3/1969 Greenhalgh ..... D21F 5/00 162/115
RE28,459 E * 7/1975 Cole ..... D21F 5/18 162/115

(Continued)

FOREIGN PATENT DOCUMENTS

DE 102004017808 A1 * 10/2005 ..... D21F 3/045
DE 102006062235 A1 6/2008

(Continued)

OTHER PUBLICATIONS

International Searching Authority, International Report and Written Opinion for International Application No. PCT/EP2015/050620, Mar. 5, 2015, 8 pages, European Patent Office, The Netherlands.

*Primary Examiner* — Jose Fortuna
(74) *Attorney, Agent, or Firm* — Alston & Bird LLP

(57) ABSTRACT

The invention relates to a process and a machine for making a tissue paper web (W) in which the tissue paper web W is passed through an extended nip N formed between an extended nip unit (2) and a Yankee drying cylinder (1) and in which the tissue paper web W is carried on a felt (3) through the extended nip N in such a way that, in the extended nip N, the tissue paper web W contacts the outer surface (4) of the Yankee drying cylinder (1). The web W and the felt (3) are led over a suction roll (5) prior to the extended nip N in such a way that the felt (3) contacts the suction roll (5) and the tissue paper web W is separated from the suction roll (5) by the felt (3). The suction roll (5) has a suction zone (6) over which the felt (3) and the tissue paper web W pass together, and a first hood (7) is arranged opposite the suction roll (5) and partially surrounds the suction roll (5). The first hood (7) has an extension around the suction roll such the first hood (7) covers the entire suction zone (6), and moist hot air is fed from the first hood (7) and sucked through the tissue paper web and the felt (3) by the suction roll (5). The tissue paper web W is directly exposed to the first hood (7) such that the moist hot air (Continued)

reaches the tissue paper web W without passing through a fabric before reaching the tissue paper web W. The Yankee drying cylinder (1) is covered by a second hood (8) which is a Yankee hood which has an air heating and distribution system (9) and hot exhaust air from the second hood (8) is fed through a conduit (10) to the first hood (7) and used to supply the first hood (7) with moist hot air. The moist hot air has a temperature in the range of 130° C.-300° C. and a moisture content of 300 g/kg dry air-1000 g/kg dry air at a rate of 90-130 $m^3$/minute per square meter suction zone area. The moist air is then sucked through the tissue paper web W by the suction roll (5) such that moisture condensates on the tissue paper web W and thereby raises the temperature of the tissue paper web W before the tissue paper web W passes through the extended nip N.

20 Claims, 3 Drawing Sheets

(56) References Cited

U.S. PATENT DOCUMENTS

| | | | | |
|---|---|---|---|---|
| 4,139,410 | A | 2/1979 | Tapio et al. | |
| 5,901,918 | A | 5/1999 | Klerelid et al. | |
| 6,083,349 | A | 7/2000 | Schiel | |
| 6,235,160 | B1 | 5/2001 | Tietz et al. | |
| 6,780,282 | B2 | 8/2004 | Scherb et al. | |
| 8,398,822 | B2 | 3/2013 | Mennucci et al. | |
| 2008/0189981 | A1 | 8/2008 | Münch | |
| 2009/0288311 | A1 | 11/2009 | Da Silva et al. | |
| 2015/0159329 | A1* | 6/2015 | Tan | D21H 17/55 162/111 |
| 2016/0362839 | A1* | 12/2016 | Bomstad | D21F 11/14 |
| 2017/0002515 | A1* | 1/2017 | Saikkonen | D21F 5/181 |

FOREIGN PATENT DOCUMENTS

| | | | | |
|---|---|---|---|---|
| EP | 1678374 | B1 | 2/2008 | |
| EP | 1959053 | B1 | 12/2010 | |
| EP | 2085513 | B1 | 9/2011 | |
| EP | 2476805 | B1 | 8/2013 | |
| IT | EP 2896743 | A1 * | 7/2015 | D21F 5/181 |
| IT | WO 2015107094 | A1 * | 7/2015 | D21F 5/181 |
| IT | EP 2896743 | B1 * | 6/2016 | D21F 5/181 |
| WO | WO 2011/085848 | A1 | 7/2011 | |

* cited by examiner

PROCESS AND A MACHINE FOR MAKING A TISSUE PAPER WEB

CROSS REFERENCE TO RELATED APPLICATIONS

This application is a National Stage Application, filed under 35 U.S.C. 371, of International Application No. PCT/EP2015/050620, filed Jan. 15, 2015, which claims priority to European Application No. 14151720.1, filed Jan. 20, 2014; the contents of which are hereby incorporated by reference in their entirety.

BACKGROUND

Related Field

The present invention relates to a process and a machine for making a tissue paper web.

Description of Related Art

During manufacturing of tissue paper, a newly formed wet tissue paper web is taken from the forming section to a drying cylinder which may be a through-air-drying cylinder or a Yankee drying cylinder. If a Yankee drying cylinder is used, the tissue paper web is creped away from the surface of the Yankee drying cylinder when the web has been dried. When the tissue paper web is transferred to a Yankee drying cylinder, this is typically made in a press nip through which a felt is passed and where the press nip is formed between the Yankee drying cylinder and a press roll inside the loop of the felt. Such an arrangement is disclosed in, for example, U.S. Pat. No. 4,139,410. It has also been suggested that a nip against a drying cylinder can be an elongated nip where a shoe press unit is placed inside the loop of the felt. Such a solution is disclosed in for example U.S. Pat. No. 6,235,160 which shows an arrangement in which the felt and the paper web pass a suction roll located before the nip formed against a heated drying cylinder and where a shoe press unit inside the felt loop forms a nip against the heated drying cylinder. It is stated that the use of an elongated press nip (i.e. an extended nip) enables an intensive and volume-preserving drainage. In U.S. Pat. No. 6,780,282, an arrangement is disclosed which is largely similar to the arrangement of U.S. Pat. No. 6,235,160 but in which a hood is placed opposite a suctioned unit placed before the nip against the heated drying cylinder. The hood is said to comprise an overpressure fluid comprising at least one of overheated steam and dry and/or moist air. A similar arrangement is disclosed also in U.S. Pat. No. 6,083,349. In U.S. Pat. No. 6,083,349, hot air is blown against a shoe press that acts against a drying cylinder. Such an arrangement entails the disadvantage that the equipment may get dirty faster since other equipment such as a Yankee dryer coating shower may be used nearby. The web should preferably be heated at some distance away from the press nip against the drying cylinder. European patent No. 1959053 B1 discloses an arrangement that comprises a drying cylinder such as a Yankee cylinder and where a press element forms a press nip with the drying cylinder. In that document, it is described how a structured permeable fabric carries the paper web to the drying cylinder and it is stated that the structured permeable fabric may be a wire. Before the paper web has reached the Yankee cylinder, the paper web passes a through-flow drying apparatus having a feed air chamber and a waste air chamber formed by the suction box of a suction roll. Air fed to the feed air chamber is taken to some extent from a hood which is assigned to a drying cylinder such as a Yankee drying cylinder. The feed air chamber is placed inside the loop of the structured permeable fabric and air from the feed air chamber must pass through the structured permeable fabric before it reaches the paper web. A further permeable press fabric 24 is also arranged in a loop around the feed air chamber and is used to press the structured permeable fabric and the paper web against the suction roll. An additional dewatering fabric may also be arranged around the suction roll. The arrangement according to EP 1959053 is intended to cause drying of the paper web by means of hot air. Air which has left the suction roll may be recirculated back to the waste air chamber and a water separator is placed in the recirculation loop.

The object of the present invention is to provide an improved process and an improved machine for making a tissue paper web in which dewatering of the tissue paper web can be achieved in a more energy-efficient way.

BRIEF SUMMARY

The invention relates to a process for making a tissue paper web in which the tissue paper web is passed through an extended nip formed between an extended nip unit and a Yankee drying cylinder. In the process, the tissue paper web is carried on a felt through the extended nip in such a way that, in the extended nip, the tissue paper web contacts the outer surface of the Yankee drying cylinder. The web and the felt are led over a suction roll prior to the extended nip in such a way that the felt contacts the suction roll and the tissue paper web is separated from the suction roll by the felt. The suction roll has a suction zone over which the felt and the tissue paper web pass together and a first hood is arranged opposite the suction roll and partially surrounds the suction roll. The first hood has an extension around the suction roll such the first hood covers the entire suction zone. Moist hot air is fed from the first hood and is sucked through the tissue paper web and the felt by the suction roll and the tissue paper web is directly exposed to the first hood such that the moist hot air reaches the tissue paper web without passing through a fabric before reaching the tissue paper web. The Yankee drying cylinder is covered by a second hood which is a Yankee hood which has an air heating and distribution system and hot exhaust air from the second hood is fed through a conduit to the first hood and used to supply the first hood with moist hot air having a temperature in the range of 130° C.-300° C., preferably 150° C.-300° C. and a moisture content of 300 g water/kg dry air-1000 g water/kg dry air at a rate of 90-130 $m^3$/minute per square meter suction zone area of the suction roll. The hot moist air is then sucked through the tissue paper web by the suction roll such that moisture condensates on the tissue paper web and thereby raises the temperature of the tissue paper web before the tissue paper web passes through the extended nip.

In advantageous embodiments of the invention, an air supply fan is arranged to blow hot and moist exhaust air from the second hood to the first hood and the speed of the air supply fan may be controlled to adapt the quantity of exhaust air blown to the first hood to the quantity of exhaust air that is available from the second hood.

It should be understood that the amount of moist hot air to which the tissue paper web is exposed should be adequate in relation to the surface area of the tissue paper web that is exposed to the moist hot air. Since the moist hot air is supplied continuously and since the tissue paper web is moving, this means that the volume flow of moist hot air should be adequate in relation to the speed at which the tissue paper web travels.

The invention is primarily intended for applications where the tissue paper web travels at a speed of 1500 m/s-2500 m/s and preferably at speeds in the range of 1800 m/s-2400 m/s. At such speeds, the volume flow of 90-130 $m^3$/minute per square meter suction zone to which the tissue paper web is exposed will be suitable for achieving the desired purpose.

When the tissue paper web W travels at speeds of 1500 m/s-2500 m/s, the distance from the point where the felt leaves the suction roll to the extended nip may be 0.4 m-3 m, preferably 0.5 m-2 m. It should be understood that embodiments are also conceivable in which the web travels at speeds above 2500 m/s.

In embodiments of the invention, the distance from the first hood to the tissue paper web may be 10 mm-20 mm and the moist hot air may exit the first hood at a speed of 30 m/s-60 m/s.

In most realistic embodiments, the suction roll has a diameter in the range of 500 mm-2000 mm and the suction zone normally extends in the circumferential direction for 80°-130° while the felt and the tissue paper web wrap the entire suction zone.

The first hood and the conduit leading from the second hood to the first hood may be provided with insulation in order to reduce heat losses.

In preferred embodiments of the invention, the extended nip unit is operated such that the linear load in the extended nip is in the range of 80 kN/m-160 kN/m and the length of the extended nip in the machine direction may be in the range of 50 mm-250 mm in many realistic embodiments, preferably 80 mm-150 mm and even more preferred 110 mm-150 mm.

The invention also relates to a machine for making a tissue paper web. The machine comprises a Yankee drying cylinder and an extended nip unit that is arranged to form an extended nip with the Yankee drying cylinder. The machine further comprises a felt arranged to carry a tissue paper web on the felt through the extended nip in such a way that, in the extended nip, the tissue paper web contacts the outer surface of the Yankee drying cylinder. The machine also comprises a suction roll placed before the extended nip in such a way that, during operation, the felt contacts the suction roll and the tissue paper web will be separated from the suction roll by the felt. The suction roll has a suction zone that is wrapped by the felt, and the machine further comprises a first hood that is arranged opposite the suction roll and partially surrounds the suction roll. The first hood has an extension around the suction roll such the first hood covers the entire suction zone and the first hood is arranged to feed moist hot air from the first hood directly against the tissue paper web such that the suction roll can suck the hot moist air through the tissue paper web and the felt. The tissue paper web is directly exposed to the first hood during operation such that the moist hot air can reach the tissue paper web without passing through a fabric. The Yankee drying cylinder is covered by a second hood which is a Yankee hood that has an air heating and distribution system and wherein hot exhaust air from the second hood is can be fed through a conduit to the first hood and used to supply the first hood with moist hot air having a temperature in the range of 130° C.-300° C., preferably 150° C.-300° C. and a moisture content of 300 g/kg dry air-1000 mg/kg dry air at a rate of 90-130 $m^3$/minute per square meter suction zone area of the suction roll which hot moist air can then be sucked through the tissue paper web by the suction roll such that moisture condensates on the tissue paper web and thereby raises the temperature of the tissue paper web before the tissue paper web passes through the extended nip.

In embodiments of the invention, an air supply fan is arranged to blow hot and moist exhaust air from the second hood to the first hood and a control device may optionally be connected to the air supply fan and arranged to control the speed of the air supply fan such that the quantity of exhaust air blown to the first hood can be regulated.

In many realistic embodiments, the distance from the first hood to the tissue paper web may be 10 mm-20 mm during operation.

In embodiments of the invention, the distance from the point where the felt leaves the suction roll to the extended nip is 0.4 m-3 m, preferably 0.5 m-2 m.

The first hood and the conduit leading from the second hood to the first hood may optionally be provided with insulation in order to reduce heat losses.

DETAILED DESCRIPTION OF VARIOUS EMBODIMENTS

Figure 1:
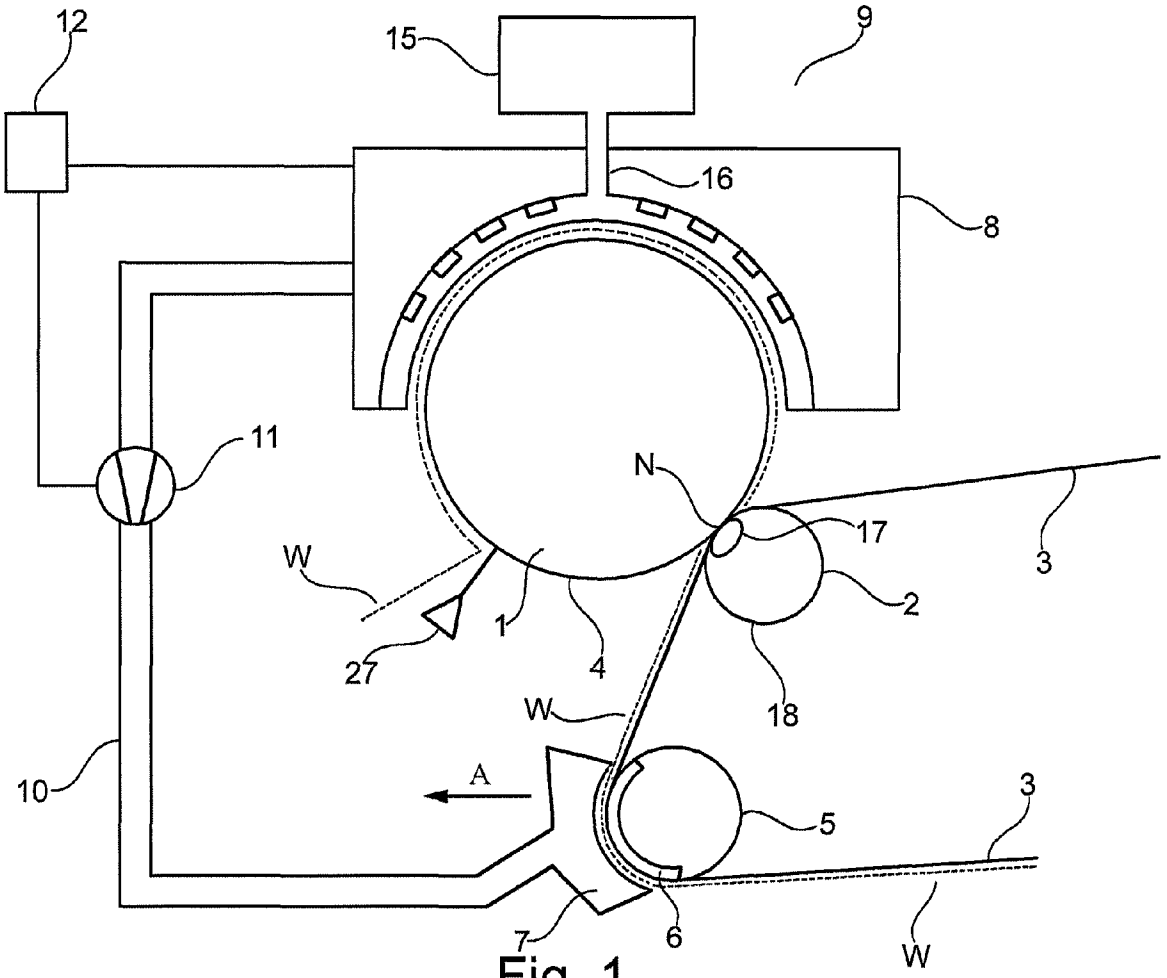
FIG. 1 is a schematic side view of a machine and a process according to the invention

With reference to FIG. 1, the invention relates to a process for making a tissue paper web W. The tissue web W has first been formed in a former such as a crescent former where a fibrous stock suspension is injected by a head box into a gap between two fabrics. Since this is a well-known procedure, it will not be described further in this application. The newly formed tissue paper web is carried forward for pressing and drying. For example, it may be carried forward on the lower side of a felt 3 which, in many practical embodiments, may be one of the fabrics between which the tissue paper web has originally been formed. The tissue paper web W is carried by the felt and passed together with the felt 3 through an extended nip N formed between an extended nip unit 2 and a Yankee drying cylinder 1.

The extended nip unit 2 is preferably an enclosed roll having a flexible tubular jacket 18 (such as a shoe press belt) which can be made of polyurethane or a material that comprises polyurethane or has similar properties. The extended nip unit may also have a press body 17 which may be a concave shoe of metal, for example steel. The press body 17 could also be an elastically deformable body and the extended nip unit could be designed according to, for example, European patent No. 1678374. The extended nip unit could also be designed in other ways. For example, the extended nip unit 2 could be designed in the way disclosed in EP 2085513 but other known extended nip units could also be used.

As can be seen in FIG. 1, the tissue paper web W is carried on the felt 3 through the extended nip N in such a way that, in the extended nip N, the tissue paper web W contacts the outer surface 4 of the Yankee drying cylinder 1. The web W and the felt 3 are led over a suction roll 5 prior to the extended nip N in such a way that the felt 3 contacts the suction roll 5 and the tissue paper web W is separated from the suction roll 5 by the felt 3. The suction roll 5 has a suction zone 6 over which the felt 3 and the tissue paper web W pass together. A first hood 7 is arranged opposite the suction roll 5 and partially surrounds the suction roll 5 and the first hood 7 has such an extension around the suction roll that the first hood 7 covers the entire suction zone 6. In the inventive process, moist hot air is fed from the first hood 7 and sucked through the tissue paper web and the felt 3 by the suction roll 5. During this, the tissue paper web W is directly exposed to the first hood 7 such that the moist hot air reaches the tissue paper web W without having to pass through any fabric before reaching the tissue paper web. The Yankee drying cylinder 1 is covered by a second hood 8 which is a Yankee hood which has an air heating and distribution system 9. The heating and air distribution system 9 may comprise one or several heaters 15 and conduits 16 (shown as 16*a*, 16*b* in FIG. 3) through which hot air can be fed to the second hood 8, i.e. the Yankee hood. This hot air is blown onto the tissue paper web and contributes to the evaporation of water from the tissue paper web. Waste air from the Yankee hood can then be exhausted from the Yankee hood and this exhaust air (waste air) is moist and hot. According to the invention, hot exhaust air is taken from the second hood 8 and fed through a conduit 10 to the first hood 7 and used to supply the first hood 7 with the moist hot air. The moist hot air has a temperature in the range of 130° C.-300° C. and preferably in the range of 150° C.-300° C. and a moisture content of 300 g water/kg dry air-1000 g water/kg dry air (i.e. 300 grams of water per kilogram dry air-1000 grams of water per kilogram dry air). The volume flow of the moist hot air should suitably be such that it is delivered at a rate of 90-130 $m^3$/minute per square meter suction zone area of the suction roll. In other words: for every square meter ($m^2$) of the area of the suction zone 6 of the suction roll 5, the volume flow of moist hot air is 90 $m^3$-130 $m^3$ per minute. In this way, a sufficient quantity of hot moist air can be delivered to the tissue paper web. This hot moist air is then sucked through the tissue paper web W by the suction roll 5. When the hot moist air is sucked through the tissue paper web W, moisture in the air condensates on the tissue paper web W and thereby raises the temperature of the tissue paper web W before the tissue paper web W passes through the extended nip N. The temperature of the tissue paper web would be raised also by hot air that contained no moisture at all but condensation produces a better heating effect, even if only a part of the water in the moist hot air condensates.

In many realistic embodiments of the invention, the volume flow of moist hot air may be in the range of 100 $m^3$-120 $m^3$ per minute and square meter suction zone area.

The tissue paper web W may travel at speeds of 1500 m/s-2500 m/s or 1700 m/s-2500 m/s and preferably 1800 m/s-2400 m/s. Embodiments are conceivable in which the web W travels at a speed of 1800 m/s-2000 m/s.

In one realistic embodiment, the suction roll may have a diameter of 1.20 meters and the suction zone may have an extension in the axial direction of 5.70 m while the suction zone 6 extends for 120° in the circumferential direction (a third of the total circumference of the suction roll). The total area of the suction zone may then be calculated as about 7.16 $m^2$. The total air flow from the first hood 7 through the tissue paper web and into the suction roll may be 13.7 $m^3$/s. For every minute, the total air flow would then be about 114.8 $m^3$ per square meter suction zone area.

During normal operating conditions, the tissue paper web W can be expected to have a temperature in the range of 18° C.-35° C. which is much lower than the dew point for the hot moist air. When the moist hot air reaches the tissue paper web, moisture will condensate on the tissue paper web as long as the temperature of the tissue paper web is lower than the dew point of the moist hot air. All other things equal, a higher content of water in the air means a higher dew point. A higher temperature of the moist air also means that the water content in the air can be higher.

The pressure of the moist hot air coming from the second hood 8 (the Yankee hood) will normally be at about normal atmospheric pressure or slightly higher, i.e. at about 101,325 KPa. When the moist hot air reaches the first hood 7, the overpressure of the moist hot air may normally be 0.3 KPa-2 KPa but in some cases an overpressure of up to 3 KPa or even higher can be considered.

Figure 3:
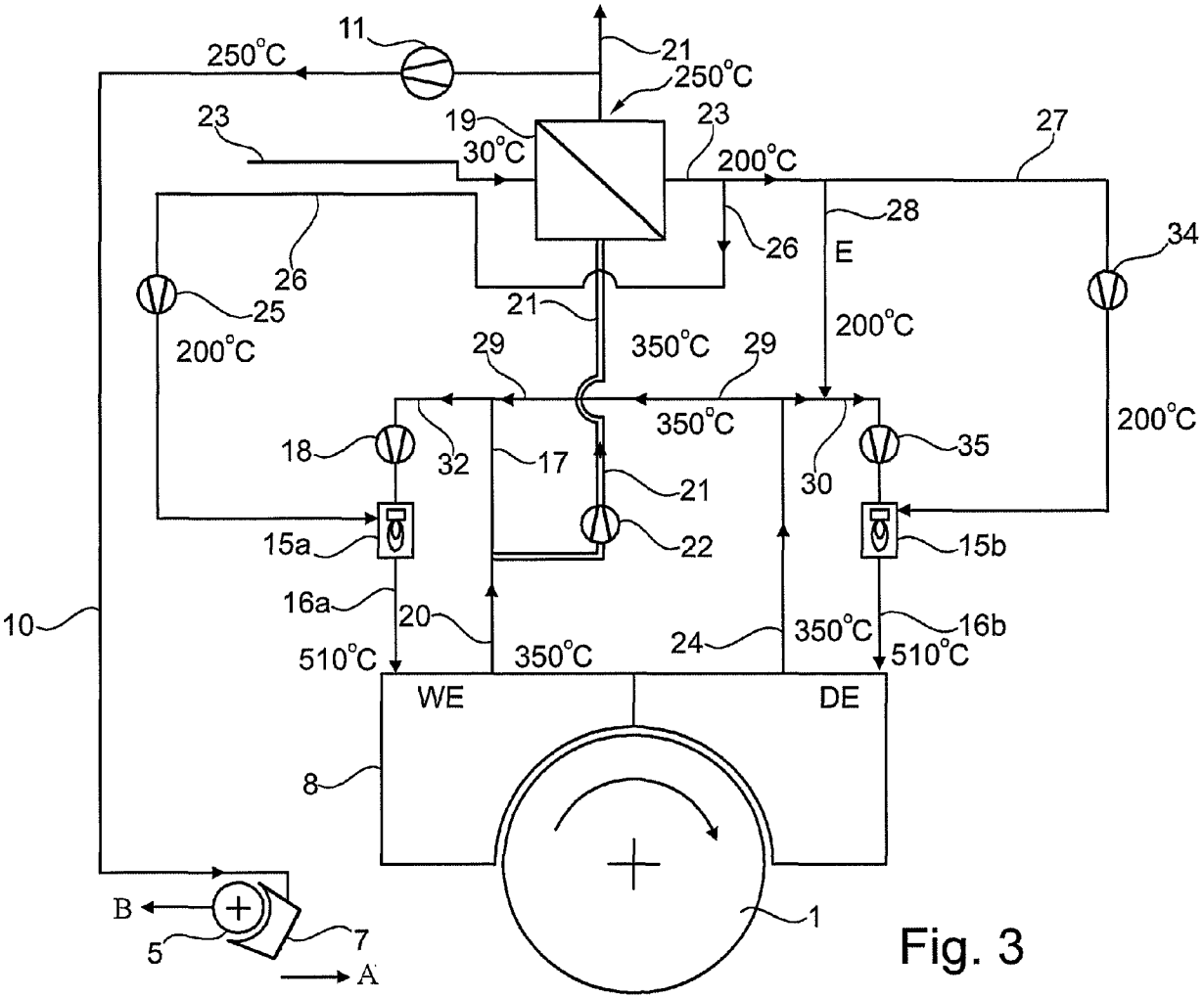
FIG. 3 is a schematic representation of an air system for providing hot air for use in the invention.

Reference will now be made to FIG. 3 which is a schematic representation of an advantageous embodiments of an air supply system which can be used for the present invention and shows some discloses some aspects that are not visible in FIG. 1. The moist hot air that is used to increase the temperature of the tissue paper web comes from the second hood 8, i.e. the Yankee Hood. Conventionally, Yankee Hood exhaust air humidity has been on the order of about 350 g water/kg dry air. The hot air blown onto the tissue paper web may typically have a temperature of 510° C. which is sufficient to cause effective evaporation of the water in the tissue paper web.

In FIG. 3, it can be seen how the second hood 8 may be divided in two halves, a wet end half WE and a dry end half DE. Hot air from both the dry end half DE and the wet end half WE is recirculated to a large extent. At the wet end, a first heater 15*a* is used to heat air which is to be used in the second hood 8 (the Yankee hood). The first heater 15*a* may suitably be a gas burner. The hot air is then blown onto the tissue paper web where water is evaporated such that the hot air absorbs large quantities of water. Evaporation of the water will also result in a reduction in temperature. Moist hot air at a lower temperature will then be evacuated from the second hood 8. At the wet end WE, moist hot air exits the Yankee hood through an exhaust conduit 20. The moist hot air that exits from the Yankee hood at the wet end may typically have a temperature of 350° C. (although other temperature values are conceivable). The conduit 20 branches off into a recirculation conduit 17 and an exit conduit 21. The exit conduit 21 leads to an air-to-air heat exchanger 19 in which incoming fresh air that arrives through a fresh air conduit 23 may be heated. The incoming fresh air typically have temperatures such as 10° C.-35° C. and in the air-to-air heat exchanger, it can be heated to temperatures that may typically be in the range of 170° C.-230° C. (other temperature values may also be possible). For example, incoming fresh air coming through the conduit 23 may be heated from 30° C. to 200° C. in the air-to-air heat exchanger 19.

In the air-to-air heat exchanger 19, the moist hot air loses heat energy such that its temperature is reduced. After passage of the air-to-air heat exchanger 19, the moist hot air that has come from the exit conduit 21 may have a temperature of, for example, 250° C. At least a part of this moist hot air is passed to the first hood 7. In the embodiment of FIG. 3, a separate conduit 10 branches off from the exit conduit 21 and leads to the first hood 7 such that only a part of the moist hot air that has went through the air-to-air heat exchanger 19 reaches the first hood and the remaining moist hot air may optionally be sent into the atmosphere or be used for other purposes. Alternatively (although not shown in FIG. 3), all the moist hot air that has passed the heat exchanger 19 may be sent to the first hood 7. A fan 22 may be used to blow moist hot air from the wet end WE of the second hood 8 and through the air-to-air heat exchanger 19.

In the embodiment disclosed in FIG. 3, a part of the moist hot air coming from the Yankee hood 8 is recirculated through the conduits 17, 32 and 16*a* back to the wet end WE of the second hood 8. The conduit 20 through which moist hot air leaves the second hood 8 branches off into two conduits, 17 and 21 and the conduit 17 is a recirculation conduit. The moist hot air going through the recirculation conduit 17 and through the following conduit 32 is sent to the first heater 15*a* which is normally a gas burner. In the heater, the moist hot air is heated once again to a higher temperature, suitably 480° C.-550° C. For example, it may be heated to 510° C. When the first heater 15*a* is a gas burner, which it would normally be, it needs combustion air. In the embodiment of FIG. 3, the combustion air for the first heater 15*a* comes through a first combustion air conduit 26 which branches off from the fresh air conduit 23 after passage of the air-to-air heat exchanger 19. The fresh air that has been heated to a temperature which may be 200° C. is sent through the combustion air conduit 26 to the first heater 15*a* where it is used for combustion (the first heater 15*a* will also be supplied with a combustible gas which is not shown in the Figure). The first heater 15*a* (normally a gas burner) heats the moist hot air that has come through the recirculation conduits 17, 32 such that the recirculated air reaches a temperature of, for example, 510° C. and this recirculated and heated air is then sent back to the wet end WE of the second hood 8 such that it can cause evaporation of water in the tissue paper web W. In the embodiment of FIG. 3, a circulation fan 18 is placed in the recirculation conduit 32 and sucks moist hot air through the conduit 32 and blows it to the first heater 15*a*. The air from the recirculation conduit 32 is heated by the first heater 15*a* and then passed through a final conduit 16*a* to the wet end WE of the Yankee hood 8.

At the dry end DE of the second hood 8 (the Yankee hood), the air may also be recirculated. With reference to FIG. 3, used air leaves the dry end DE of the Yankee hood 8 through a conduit 24 which serves as exhaust conduit for the dry end DE. At the end of the exhaust conduit 24, the exhaust conduit 24 is divided into a first branch 29 that leads to the recirculation conduit 32 that leads back to the wet end WE and a second branch conduit 30 which leads to a second heater 15*b* which is normally a gas burner. The air that has been sent through the conduits 24 and 30 is heated by the second heater 15*b* and sent through the conduit 16*b* back to the dry end DE.

When the second heater 15*b* is a gas burner (which it normally is), it needs combustion air. Air that has come through the fresh air conduit 23 and been heated in the air-to-air heat exchanger 19 can be used for this purpose. In the embodiment of FIG. 3, the fresh air conduit 23 divides into three separate branch conduits 26, 27, 28 after the heat exchanger 19. As previously explained, one of these conduits is a first combustion air conduit 26 which supplies the first heater 15*a* with combustion air. Another is the conduit 27 in FIG. 3 which serves as a second combustion air conduit that supplies the second heater 15*b* with combustion air. In the second combustion air conduit 27, a fan 34 may be placed which blows fresh air through the second combustion air conduit 27 towards the second heater 15*b*. A third branch conduit is the branch conduit 28 in FIG. 3. This conduit leads to the conduit 30 which is a part of the recirculation loop for the dry end DE. In this way, moist hot air in the recirculation loop for the dry end DE is mixed with fresh air. A fan 35 may be placed in the conduit 30 to blow the mixture of recirculated air and fresh air towards the second heater 15*b*.

The heaters 15*a* and 15*b* may be connected through an automation system (for example an automation system comprising a control device such as a computer) to fans 25, 34 in the conduits 26, 27 that lead to the heaters 15*a*, 15*b*. Normally, a machine operator will set the heaters 15*a*, 15*b* to operate at a suitable temperature (for example 510° C.). When the temperature of the heaters 15*a*, 15*b* has been set by the machine operator, the heater automation system will adjust a suitable supply of gas (since the heaters are normally gas burners) and give an indication to the fans 25, 34 to operate to supply a sufficient amount of combustion air. The fans 25, 34 may be controlled by the automation system by increasing or decreasing the speed of the fans 25, 34 or by means of blade pitch control. The supply of air through the conduit 28 may optionally be controlled by a valve or damper (not shown in the figures).

It should be understood that, while the heaters 15*a* and 15*b* would normally be gas burners, other ways of heating the air may also be considered.

The temperature of the moist hot air that reaches the first hood 7 is dependent to a large degree on the temperature of the hot air used in the second hood 8 (the Yankee hood). If the temperature used in the Yankee hood 8 is lower than 510° C., the temperature of the moist hot air that reaches the first hood 7 will also be lower, in some cases down to 150° C. and in some cases even as low as 130° C.

It will now be understood that all moist hot air that exits from the Yankee hood 8 through the conduits 20 and 24 will not necessarily be available for the first hood 7. This is especially the case if part of the moist hot air is recirculated through the recirculation loops comprising the wet end recirculation loop with the conduits 20, 17, 32, 16*a* and dry end recirculation loop with the conduits 24, 30, 16*b*. Of course, all moist hot air cannot be recirculated since this would mean that no water was actually removed. A significant part of the moist hot air must be permanently removed but there will normally be at least some recirculation. For this reason, the amount of moist hot air sent to the first hood 7 must be adapted to what is actually available at any given moment. Consequently, fresh air must be added.

Over time, there must be a balance between the amount of air that is permanently evacuated through the exhaust conduit 21 (of which at least a part leaves the system through conduit 10) and the amount of fresh air that is added through the supply conduit 23. The exhaust air is balanced by the supply of fresh air. If large amounts of air from the second hood 8 (the Yankee hood) is removed through the exhaust conduits 10 and 21, large amounts of fresh air must be added. If the heaters 15*a*, 15*b* (normally gas burners) receive hot air at a temperature of, for example, 330° C., and the temperature of the air to the Yankee hood should be 510° C., the air must be heated by an additional 180° C. in the heater. If the amount of exhaust air is reduced, a smaller amount of fresh air will be required to compensate for the exhaust air. This means that less fresh air will be added to the second recirculation loop and the second heater 15*b* may receive hot air at a higher temperature. If the temperature of the hot air that reaches the heater is, for example, 348° C., the temperature needs to be raised only by 162°. Since the temperature does not have to be raised so much, the energy consumption of the second heater 15*b* is reduced. If the heater 15*b* is a gas burner, this means a reduced consumption of gas. Reducing the amount of exhaust air and fresh air while still heating to the same temperature may thus be a way of reducing gas consumption.

If the quantity of exhaust air and fresh air is reduced while the temperature of the air used in the second hood 8 (the Yankee hood) remains the same, the moisture content of the exhaust air will increase. In this way, the moisture content in the moist hot air that reaches the first hood 7 will be increased.

The available volume flow of moist hot air from the second hood 8 (the Yankee hood) may vary over time depending on, for example, machine speed, or the amount of moist hot air that is recirculated. With reference to FIG. 1 and FIG. 3, an air supply fan 11 is advantageously arranged to blow hot and moist exhaust air from the second hood 8 to the first hood 7. As explained previously, the quantity of moist hot air that is actually available from the Yankee hood may vary. Sometimes, only a smaller amount is available. To adapt the quantity of exhaust air blown to the first hood 7 to the quantity of exhaust air that is available from the second hood 8, the speed of the air supply fan 11 may be controlled. With reference to FIG. 1, a control device 12 may be connected to the air supply fan 11 to control the speed of the fan.

It should be understood that the operation of the fan 22 may also be controlled to increase or decrease the flow of air through the conduit 21, for example by controlling the speed of the fan or by pitch control. There may optionally also be one or several adjustable valves in the conduit 21 to control the flow of moist hot air through the conduit 21.

It should be understood that the method of controlling the flows of fresh air and moist hot air to and from the Yankee hood 8, including the use of the heat exchanger 19, the conduits 17, 20, 21, 23, 24 and the fans 18, 22, 25, 34, 35 and the heaters 15*a*, 15*b* may be used independently of whether any moist hot air is used to heat the tissue paper web or not. Reduction of the flows of exhaust air and fresh air may thus reduce energy consumption. Preferably, at least 50% of the air that leaves the Yankee hood 8 should be recirculated through the recirculation loops instead of being removed from the system. Preferably, even more than 50% of the air that leaves the Yankee hood 8 should be recirculated. In one realistic embodiment of the inventive method, 25% of the moist hot air that leaves the Yankee hood 8 may leave the system permanently through conduit 21 (and of which a part is sent through conduit 10 to the first hood 7) and 75% of the moist hot air that leaves the Yankee hood through the conduits 20 and 24 is recirculated.

It should be understood that the temperature of the moist hot air, its moisture content, the length of the suction zone, the overpressure (if any) and the speed and temperature of the tissue paper web may be taken into account when the volume flow is controlled. For example, if the machine in which the inventive method is to be used must be operated at a lower speed at the same basis weight, the lower machine speed means that there is less evaporation in the Yankee hood. Lower evaporation means a lower humidity in the exhaust air which means exhaust air flow must be made lower.

Since moisture condensates on the tissue paper web W, the tissue paper web may not be dewatered to such a large extent as is passes the suction roll 5 as it would otherwise have been. Some water is removed by the suction roll but at least a part of this water is replaced by water that has condensated from the moist hot air coming from the first hood 7 even though the suction roll normally can be expected to remove more water from the tissue paper web than what condensates. Normally, sheet dryness before the suction roll 5 can be expected to be in the range of 15%-18% (i.e. the dry solids content is in the range of 15%-18%). If the suction roll 5 operates effectively, it may in some cases remove so much water that sheet dryness after the suction roll 5 may be as high as 25% due to the water removal effect of the suction roll 5. However, the most important effect is that the viscosity of the water in the tissue paper web will be significantly reduced. If the temperature of the water in the tissue paper web W is increased from 30° C. to 80° C., the viscosity will decrease by more than 50%. As a result, the following dewatering in the extended nip will become much more effective. Tests carried out have demonstrated that the use of moist hot air can increase dryness after the extended nip significantly, even at moisture levels below 300 g water/kg dry air. This higher dryness level after the extended nip is mainly the result of reduced viscosity.

As an example, it can be mentioned that tests carried out using waste air having a temperature in the range of 210° C.-250° C. and a moisture content of only up to 150 g water/kg dry air resulted in an increased dryness after the extended nip which was 1.5%-2.5% higher than when moist hot air was not used. At this level, the tissue paper web was heated only to a level of slightly below 60° C. At this temperature, viscosity has been decreased but to get a really significant improvement in dewatering, the inventors of the present invention have concluded that the temperature should be raised even more.

To achieve an optimal increase in dewatering capacity, the tissue paper web W should be raised to levels significantly higher than room temperature. At temperatures above 60° C., for example temperatures in the range of 65° C.-85° C., the viscosity will be much lower than at 30° C. To achieve such temperature increases, it is advantageous if the dew point of the moist hot air can be kept relatively high. Water in the moist hot air coming from the second hood (the Yankee hood) will continue to condensate on the tissue paper web as long as the temperature of the tissue paper web does not exceed the dew point. When the water condensates, this raises the temperature of the tissue paper web and of the water in the tissue paper web. Higher water content in the most hot air therefore means that the dew point will not be so quickly reached. When the moisture content in the moist hot water coming from the Yankee hood is in the range of 300 g water/kg dry air-1000 g water/kg dry air, the dew point will be above 70° C. At a moisture content of 500 g water/kg dry air, the dew point will be about 80° C. At such temperatures, the viscosity is dramatically reduced and dewatering in the extended nip can be made much more effective. The tissue paper web may conceivably be heated to temperatures even approaching and up to 95° C. but it is not desirable to heat the web to higher temperatures since the felt 3 would also be heated and since there could then be a risk that the flexible jacket of the extended nip unit 2 may take damage from the high temperature. The flexible jacket of a an extended nip unit such as a shoe roll is typically made of polyurethane or a material that comprises polyurethane and such materials normally take damage if they are exposed directly to temperatures significantly higher than about 80° C. Moreover, the dewatering in the extended nip may actually be disturbed by conditions under which the moisture in the tissue paper web has reached the boiling point. Ideally, the temperature of the tissue paper web W should be about 80° C. when it reaches the extended nip. Since there is a certain cooling between the suction roll 5 and the extended nip N, this means that the temperature of the tissue paper web W should ideally be raised to about 90° C.-95° C. as is passes between the suction roll 5 and the first hood 7.

On its way from the suction roll 5 to the extended nip N, the tissue paper web W normally loses some of its heat energy. Therefore, the time from the suction roll to the extended nip should not be too long. For many realistic applications today and in the near future, the tissue paper web can be expected to travel at a speed of 1800-2400 m/s. At such speeds, the distance from the point where the felt 3 leaves the suction roll 5 to the extended nip N may suitably be in the range of 0.4 m-3 m, preferably 0.5 m-2 m in order to reduce heat losses.

During operation, the distance from the first hood 7 to the tissue paper web W is preferably 10 mm-20 mm while the moist hot air exits the first hood 7 at a speed of 30 m/s-60 m/s. A distance in the range of 10 mm-20 mm means small losses to the environment while the components in question are not so close as to directly interfere with each other in such a way that it might risk disturbing their operation.

In many realistic embodiments, the suction roll 5 has a diameter in the range of 500 mm-2000 mm and the suction zone 6 extends in the circumferential direction for 80°-130° while the felt 3 and the tissue paper web W preferably wrap the entire suction zone. This dimensioning means that the suction zone will have such a length that the moist hot air will have good time to heat the tissue paper web.

Figure 2:
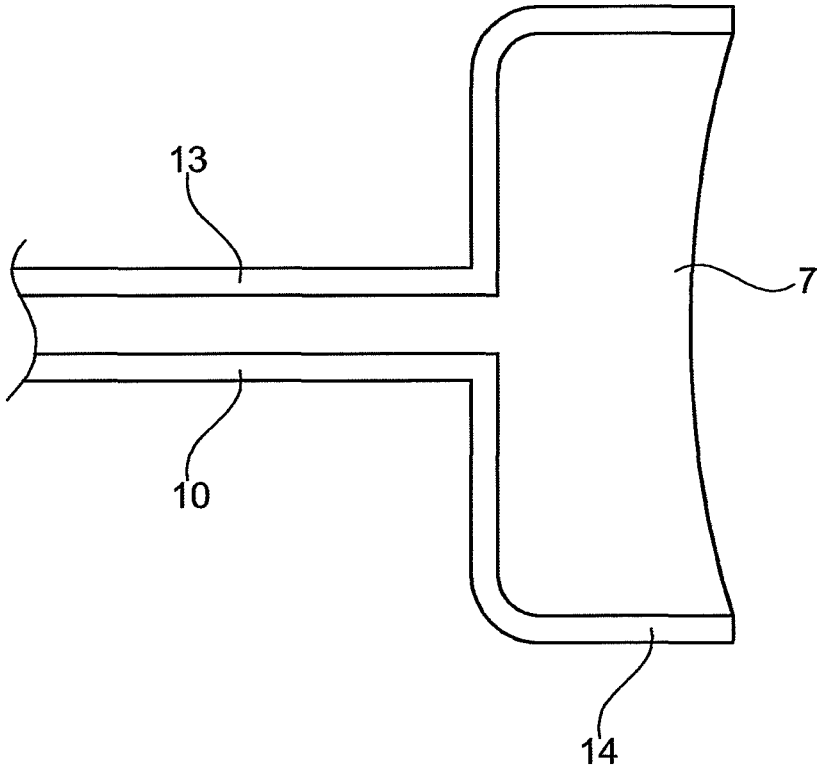
FIG. 2 is s view similar to FIG. 1 in which two components are shown in greater detail.

Preferably, the first hood 7 and the conduit 10 leading from the second hood 8 to the first hood 7 are provided with insulation 13, 14 in order to reduce heat losses. With reference to FIG. 2 that shows a part of the first hood 7 and the conduit 10, it can be seen how the first hood has an insulation layer 14 and the conduit 10 has an insulation layer 13. The insulation used may comprise, for example, a layer of mineral wool that may have a thickness in the range of, for example, 80 mm-120 mm.

With reference to FIG. 1 or FIG. 3, the first hood may be moved away from the suction roll 5 in the direction of arrow A in order to facilitate cleaning of the suction roll 5 and the first hood 7. Optionally, the first hood may be disconnected from the conduit 11 for such occasions. Alternatively, the suction roll may be movable in the direction of arrow B away from the first hood 7 as indicated in FIG. 3. Embodiments are conceivable in which both the suction roll 5 and the first hood 7 are movable away from each other in the direction of arrows A and B.

The extended nip unit 2 is preferably operated such that the linear load in the extended nip N is in the range of 80 kN/m-160 kN/m and the length of the extended nip N in the machine direction is suitably in the range of 50 mm-250 mm, preferably 80 mm-150 mm. Since the invention results in reduced viscosity, the extended nip unit may alternatively be operated at a lower linear load in order to preserve bulk.

A doctor 27 can be used to crepe the tissue paper web away from the outer surface 4 of the Yankee cylinder 1.

The tissue paper web that is creped or otherwise removed from the Yankee drying cylinder 1 can be sent to a subsequent reel-up, for example a reel-up according to U.S. Pat. No. 5,901,918.

The second hood 8 (the Yankee hood) may optionally be provided with a layer of insulation to reduce heat losses. For example, it could have a layer of mineral wool as insulation.

The Yankee cylinder 1 may be a cast iron cylinder but could also have a cylinder of welded steel as disclosed in, for example, EP 2476805 B1. It may optionally also be provided with thermal insulation at its axial ends as disclosed in, for example, U.S. Pat. No. 8,398,822.

While the invention has been discussed above in terms of a process and a machine, it should be understood that these categories (process and machine) only reflect different aspects of one and the same invention. The machine is thus used for the inventive process and the inventive process uses the machine equipment described above. The machine may thus comprise such means that are required to perform the steps of the process regardless of whether such means have been explicitly mentioned or not. In the same way, the process may comprise such steps that would be the inevitable result of using the inventive machine.

Thanks to the inventive process, viscosity of the water in the tissue paper web can be much reduced and dewatering in the extended nip significantly improved.

Since the moist hot air reaches the tissue paper web without passing through any fabric before reaching the tissue paper web, the heat transfer will be better than if the moist hot air first passes through a fabric.

The invention claimed is:

1. A process for making a tissue paper web (W) in which the tissue paper web (W) is passed through an extended nip (N) formed between an extended nip unit (2) and a Yankee drying cylinder (1) and in which the tissue paper web (W) is carried on a felt (3) through the extended nip (N) in such a way that, in the extended nip (N), the tissue paper web (W) contacts the outer surface (4) of the Yankee drying cylinder (1) and wherein the web (W) and the felt (3) are led over a suction roll (5) prior to the extended nip (N) in such a way that the felt (3) contacts the suction roll (5) and the tissue paper web (W) is separated from the suction roll (5) by the felt (3), the suction roll (5) having a suction zone (6) over which the felt (3) and the tissue paper web (W) pass together, and wherein a first hood (7) is arranged opposite the suction roll (5) and partially surrounds the suction roll (5), the first hood (7) having an extension around the suction roll such the first hood (7) covers the entire suction zone (6), and wherein moist hot air is fed from the first hood (7) and sucked through the tissue paper web and the felt (3) by the suction roll (5), the tissue paper web (W) being directly exposed to the first hood (7) such that the moist hot air reaches the tissue paper web (W) without passing through a fabric before reaching the tissue paper web (W), wherein the Yankee drying cylinder (1) is covered by a second hood (8) which is a Yankee hood which has an air heating and distribution system (9) and wherein hot exhaust air from the second hood (8) is fed through a conduit (10) to the first hood (7) and used to supply the first hood (7) with moist hot air having a temperature in the range of 130° C.-300° C. and a moisture content of 300 g water/kg dry air-1000 g water/kg dry air at a rate of 90-130 $m^3$/minute per square meter of the area of the suction zone (6) of the suction roll (5) which hot moist air is then sucked through the tissue paper web (W) by the suction roll (5) such that moisture condensates on the tissue paper web (W) and thereby raises the temperature of the tissue paper web (W) before the tissue paper web (W) passes through the extended nip (N).

2. A process according to claim 1, wherein an air supply fan (11) is arranged to blow hot and moist exhaust air from the second hood (8) to the first hood (7) and wherein the speed of the air supply fan (11) is controlled to adapt the quantity of exhaust air blown to the first hood (7) to the quantity of exhaust air that is available from the second hood (8).

3. A process according to claim 1, wherein the tissue paper web (W) travels at a speed of 1500 m/s-2500 m/s and the distance from the point where the felt (3) leaves the suction roll (5) to the extended nip (N) is 0.4 m-3 m.

4. A process according to claim 1, wherein the tissue paper web (W) travels at a speed of 1800-2400 m/s and the distance from the point where the felt (3) leaves the suction roll (5) to the extended nip (N) is 0.5 m-2 m.

5. A process according to claim 1, wherein the distance from the first hood (7) to the tissue paper web (W) is 10 mm-20 mm and the moist hot air exits the first hood (7) at a speed of 30 m/s-60 m/s.

6. A process according to claim 1, wherein the suction roll (5) has a diameter in the range of 500 mm-2000 mm and the suction zone (6) extends in the circumferential direction for 80°-130° and the felt (3) and the tissue paper web (W) wrap the entire suction zone.

7. A process according to claim 1, wherein the first hood (7) and the conduit (10) leading from the second hood (8) to the first hood (7) are provided with insulation (13, 14) in order to reduce heat losses.

8. A process according to claim 1, wherein the extended nip unit (2) is operated such that the linear load in the extended nip (N) is in the range of 80 kN/m-160 kN/m and wherein the length of the extended nip (N) in the machine direction is in the range of 50 mm-250 mm.

9. A process according to claim 1, wherein the extended nip unit (2) is operated such that the linear load in the extended nip (N) is in the range of 80 kN/m-160 kN/m and wherein the length of the extended nip (N) in the machine direction is in the range of 80 mm-150 mm.

10. A process according to claim 1, wherein the tissue paper web (W) travels at a speed of 1500 m/s-2500 m/s.

11. A process according to claim 1, wherein the tissue paper web (W) travels at a speed of 1800 m/s-2400 m/s.

12. A machine for making a tissue paper web (W), the machine comprising a Yankee drying cylinder (1), an extended nip unit (2) that is arranged to form an extended nip (N) with the Yankee drying cylinder (1), a felt (3) arranged to carry a tissue paper web (W) on the felt (3) through the extended nip (N) in such a way that, in the extended nip (N), the tissue paper web (W) contacts the outer surface (4) of the Yankee drying cylinder (1) and wherein the machine further comprises a suction roll (5) placed before the extended nip (N) in such a way that, during operation, the felt (3) contacts the suction roll (5) and the tissue paper web (W) will be separated from the suction roll (5) by the felt (3), the suction roll (5) having a suction zone (6) that is wrapped by the felt (3), and wherein the machine further comprises a first hood (7) that is arranged opposite the suction roll (7) and partially surrounds the suction roll (7), the first hood (7) having an extension around the suction roll (5) such the first hood covers the entire suction zone (6), the first hood (7) being arranged to feed moist hot air from the first hood (7) directly against the tissue paper web (W) such that the suction roll (5) can suck the hot moist air through the tissue paper web (W) and the felt (3), the tissue paper web (W) being directly exposed to the first hood (7) such that the moist hot air can reach the tissue paper web (W) without passing through a fabric, wherein the Yankee drying cylinder (1) is covered by a second hood (8) which is a Yankee hood which has an air heating and distribution system (9) and wherein hot exhaust air from the second hood (8) is can be fed through a conduit (10) to the first hood (7) and used to supply the first hood (7) with moist hot air having a temperature in the range of 130° C.-300° C. and a moisture content of 300 g/kg dry air-1000 g/kg dry air at a rate of 90-130 $m^3$/minute per square meter area of the suction zone (6) of the suction roll (5) which hot moist air can then be sucked through the tissue paper web (W) by the suction roll (5) such that moisture condensates on the tissue paper web (W) and thereby raises the temperature of the tissue paper web (W) before the tissue paper web (W) passes through the extended nip (N).

13. A machine according to claim 12, wherein an air supply fan (11) is arranged to blow hot and moist exhaust air from the second hood (8) to the first hood (7) and wherein a control device (12) is connected to the air supply fan (11) and arranged to control the speed of the air supply fan (11) such that the quantity of exhaust air blown to the first hood (7) can be regulated.

14. A process according to claim 12, wherein, during operation, the distance from the first hood (7) to the tissue paper web is 10 mm-20 mm.

15. A machine according to claim 12, wherein the distance from the point where the felt (3) leaves the suction roll (5) to the extended nip is 0.4 m-3 m.

16. A machine according to claim 12, wherein the distance from the point where the felt (3) leaves the suction roll (5) to the extended nip is 0.5 m-2 m.

17. A machine according to claim 12, wherein the first hood (7) and the conduit (10) leading from the second hood (8) to the first hood (7) are provided with insulation (13, 14) in order to reduce heat losses.

18. A machine according to claim 12, wherein the first hood (7) is movable away from the suction roll (5).

19. A machine according to claim 12, wherein the tissue paper web travels at a speed of 1500 m/s-2500 m/s.

20. A machine according to claim 12, wherein the tissue paper web travels at a speed of 1800 m/s-2400 m/s.

* * * * *